United States Patent [19]

Exertier

[11] Patent Number: 4,523,959

[45] Date of Patent: Jun. 18, 1985

[54] PURIFICATION OF SUGARCANE JUICE

[75] Inventor: Michel Exertier, Orsay, France

[73] Assignee: Rhone-Poulenc Industries, Paris, France

[21] Appl. No.: 536,224

[22] Filed: Sep. 27, 1983

Related U.S. Application Data

[63] Continuation of Ser. No. 294,733, Aug. 20, 1981, abandoned.

[30] Foreign Application Priority Data

Sep. 19, 1980 [FR] France ..... 80 20173

[51] Int. Cl.[3] ..... C13D 3/14

[52] U.S. Cl. ..... 127/46.2; 127/55; 210/692

[58] Field of Search ..... 127/46.2, 55; 210/670, 210/692, 679, 683, 685, 686, 687, 917

[56] References Cited

U.S. PATENT DOCUMENTS

| | | | |
|---|---|---|---|
| 2,340,110 | 1/1944 | Alelio | 210/679 |
| 2,340,111 | 1/1944 | Alelio | 210/679 |
| 2,640,849 | 6/1953 | Liggett et al. | 127/46.2 X |
| 2,890,972 | 6/1959 | Wheaton | 127/46.3 |
| 2,971,868 | 2/1961 | Assalini | 127/46.2 |
| 3,420,709 | 1/1969 | Barrett et al. | 210/917 X |
| 4,040,861 | 8/1977 | Waloh | 127/46.2 |
| 4,111,714 | 9/1978 | Hippchen et al. | 127/46.2 |
| 4,288,619 | 9/1981 | Devos et al. | 127/46.2 X |

FOREIGN PATENT DOCUMENTS

| | | | |
|---|---|---|---|
| 984713 | 3/1965 | United Kingdom | 127/46.2 |
| 2064581 | 6/1981 | United Kingdom . | |
| 2084184 | 4/1982 | United Kingdom | 127/46.2 |

OTHER PUBLICATIONS

Meade-Chen; Cane Sugar Handbook, 10th Edition; John Wiley and Sons, N.Y.; 1977; Copy in Gp. 170; pp. 478-481, 43-45.

Fort et al., Sugar Cane Products Division, Southern Regional Research Lab, New Orleans, La (USDA); "Comparison of the Effectiveness of Selected Ion-Exchange Resins for the Purification of Clarified Sugar Cane Juice".

*Primary Examiner*—Kenneth M. Schor

*Attorney, Agent, or Firm*—Herbert F. Schwartz; James F. Haley, Jr.; Eugene S. Indyk

[57] ABSTRACT

A process for purifying sugarcane juices by contacting the juices to be purified in succession with a hydrophobic adsorbent, a supported strong anion exchange material or a hydrophobic adsorbent having anion exchanger groups, an anion exchange resin, and a cation exchange resin. The process may be used to purify low-grade sugar solutions. The process may be used in the sugar industries to obtain sugar syrups, sucrose, aconitic acid, and amino acids.

13 Claims, No Drawings

PURIFICATION OF SUGARCANE JUICE

This is a continuation of application Ser. No. 294,733, filed Aug. 20, 1981, entitled PURIFICATION OF SUGARCANE JUICES, now abandoned.

BACKGROUND OF THE INVENTION

The present invention relates to purification of sugarcane juices.

Broadly speaking, the manufacture of sugar from sugarcane consists of crushing the cane to extract its juices; clarifying the juice by liming with substantial amounts of lime or lime and magnesia and then heating and filtering the juice; evaporating the juice; and crystallizing and refining the raw sugar (by a complicated treatment). However, the last step is lengthy and expensive, since it requires a redissolving of the raw sugar and results in large losses of sucrose.

It has been proposed to treat sugar juices by ion-exchange resins. However, these techniques are limited to the demineralization of the juice (followed or preceded by bleaching) or the ion-exchange step is used to lime. Additionally, ion-exchange resins may be rapidly inactivated because of difficulties in regeneration. None of these processes makes it possible to extract and recover the amino acids and aconitic acid.

SUMMARY OF THE INVENTION

The process of the present invention avoids clarification, heating, and refining operations and makes it possible, by eliminating the coloring matter, nitrogen materials and inorganic and organic salts, to obtain a purified sugar syrup, at a good sucrose yield. It also makes it possible to obtain solutions which are enriched in aconitic acids and amino acids.

The process consists in treating sugarcane juices with ion exchangers which are then eluted. The process is characterized by the fact that the juices to be purified are contacted in succession with a hydrophobic adsorbent, a strong anion exchanger on a support, and, in any order, an anion exchange resin and a cation exchange resin.

The process of the invention may be used in the sugar industries for extracting sugarcane sugars and obtaining aconitic acid and amino acids.

DETAILED DESCRIPTION OF THE INVENTION

The hydrophobic absorbent consists of a cross-linked polymer or a mineral support, alumina or silica, covered with an amount of less than 15 mg/m$^2$ of a cross-linked polymer film. It has a particle size of 50 to 5000 $\mu$m, a specific surface of 5 to 600 m$^2$/g, a pore diameter of 60 to 3000 Å, and a pore volume of 0.2 to 4 ml/g, more particularly 0.5 to 2 ml/g and preferably 0.75 to 1.5 ml/g.

The polymer, which is known, is obtained by suspension polymerization of vinyl aromatic monomers, such as styrene or derivatives, used alone or in mixture with eath other and/or with at least a copolymerizable monomer, such as acrylates and methacrylates of alkyl ($C_1$–$C_5$), acrylonitrile and butadiene. The cross-linking is provided by means of polyfunctional monomers, such as mono- or poly-alkyleneglycol diacrylates or dimethacrylates, divinylbenzene, vinyl trialkoxy silanes, vinyl trihalosilanes, and bis-methylene acrylamide. Cross-linking occurs in the presence of an initiator or of ultraviolet rays.

The mineral support is coated with the cross-linked polymer by impregnating the support with a solution of the monomer or monomers enumerated above (and possibly the initiator) in a solvent and the monomers polymerized and cross-linked in accordance with the known processes. The solvent may be any solvent for the monomers and the initiator, its boiling point being preferably as low as possible in order to favor its subsequent evaporation. For example, the solvent may be methylene chloride, ethyl ether, benzene, acetone, or ethyl acetate.

The strong anion exchanger on a support is formed of a mineral support, alumina or silica, covered with an amount of less than 15 mg/m$^2$ of a film of cross-linked polymer containing or bearing quaternary ammonium salt exchange groups. It has a particle size of 4 to 5000 $\mu$m and preferably 50 to 2000 $\mu$m, a specific surface of 5 to 150 m$^2$/g and preferably 20 to 50 m$^2$/g, a pore diameter of 60 to 3000 Å and preferably 300 to 1500 Å, a pore volume of 0.2 to 4 ml/g and preferably 0.5 to 1.5 ml/g, and an ion capacity of less than 2 meq/g.

The quaternary ammonium salt groups which form part of the chain of the cross-linked polymer or are fixed to the cross-linked polymer, which covers the entire surface of the support, are represented by the formula $—N^{(+)}—(R)_3X^{(-)}$ in which R, which is identical or different, represents an alkyl or hydroxyalkyl group having 1 to 4 carbon atoms and X represents an inorganic or organic anion (e.g., chloride, sulfate, nitrate, phosphate or citrate).

The cross-linked polymers which cover the surface of the supports are known products obtained from monomers such as: epoxy compounds, which cross-link with the polyamines as catalyst; formaldehyde, which cross-links by polycondensation with urea, melamine, polyamines, or phenols; and the vinyl monomers (e.g., vinyl pyridine, styrene and derivatives), which cross link with polyfunctional monomers such as mono- or polyalkyleneglycol diacrylates or dimethacrylates, divinylbenzene, vinyltrialkoxysilanes, vinyltrihalosilanes, and bis-methylene acrylamide in the presence of an initiator or of ultraviolet rays.

Coating the mineral support with the cross-linked polymer is effected using the same process described above for coating the hydrophobic adsorbent.

If the cross-linked polymer on the surface of the support does not have exchange groups in its chain, it is necessary to modify it. This is true in particular of cross-linked polymers having a base of styrene or its derivatives and polymers of formaldehyde with urea, melamine, polyamines, or phenols. This modification may be effected by any known process.

In accordance with a variant of the process of the present invention, a hydrophobic adsorbent bearing anion exchange groups is used instead of the hydrophobic adsorbent and the strong anion exchanger on a support.

This hydrophobic adsorbent with anion exchanger groups is formed of a cross-linked polymer or a mineral support covered with a film of cross-linked polymer, identical to those of the hydrophobic adsorbent and has quaternary ammonium salt exchanger groups which are identical to those of the supported anion exchanger. However, the quantity of exchange groups which it contains is always less than the maximum number of exchange groups which it can contain, which results in an ionic capacity less than the maximum ionic capacity and in general less than 1.5 meq/g.

The hydrophobic adsorbent with anion exchange groups is obtained in the same manner as the hydrophobic adsorbent, with modification of the polymer in accordance with any known processes to add the exchange groups to it.

The anion exchange resin is formed of a cross-linked polymer containing or bearing exchange groups such as primary, secondary, or tertiary amines, or quaternary ammonium salts, of the general formulas, respectively, $—NH_2$, —NH—R, $—N—(R)_2$, $—N^{(+)}—(R)_3X^{(-)}$ in which R, which is identical or different, represents an alkyl or hydroxyalkyl group having 1 to 4 carbon atoms and X is an inorganic or organic ion such as chloride, sulfate, nitrate, phosphate, or citrate.

The cation exchange resin is formed of a cross-linked polymer containing or bearing exchange groups such as carboxylic or sulfonic acids of the general formulas —COOH or $—SO_3H$.

The cross-linked polymers which form the base of the ion exchange resins are known products obtained by suspension polymerization of vinyl monomers such as vinylpyridine, styrene and derivatives, acrylic and methacrylic acids, alkyl ($C_1$–$C_5$) acrylates and methacrylates, and acrylonitrile, used alone or in combination with each other and/or with other copolymerizable monomers such as butadiene in the presence of polyfunctional monomers such as mono- or poly-alkylene glycol diacrylates or dimethacrylates, divinvylbenzene, vinyltrihalosilanes, vinyltrialkoxysilanes, and bismethylene acrylamide and in the presence of an initiator or of ultraviolet rays. The amount of polyfunctional monomer is a function of the porosity of the polymer to be obtained.

The two ion exchange resins have a particle size of 100 to 5000 μm and an ionic capacity of 0.5 to 4 meq/ml.

As with the polymer for the anion exchange resin, if the cross-linked polymer for the cation exchange resin does not have exchange groups in its chain it is necessary to modify it. This is true in particular of cross-liked polymers having a base of styrene or its derivatives, alkyl acrylates or methacrylates, or acrylonitrile. This modification of the polymer is effected by any known process.

The juices to be purified are obtained in any known manner by reducing the cane into pieces, and crushing and expressing them to remove the solid materials from the opalescent green juices. The juices are centrifuged and filtered after addition of a flocculating agent (e.g., lime, baryta or magnesia). The sugar concentration of the raw juices obtained is from about 10° to 25° Brix.

The pH of the raw juices, which is between 5 and 12, and preferably between 6 and 11, remains within these limits upon the contacting of the juices with the hydrophobic adsorbent, the supported anion exchange resin or the hydrophobic adsorbent with anion exchange groups and the anion exchange resin. On the other hand, during the contacting with the cation exchanger resin, the juices are acidified and their pH may then reach 1.2.

Treatment of the raw juices with the hydrophobic adsorbent, the supported anion exchange resin or the hydrophobic adsorbent with anion exchange groups, and the anion and cation exchange resins is effected at temperatures of between 15° and 80° C. To avoid inversion of the sucrose, it is preferable to operate at temperatures below that range during the treatment with the cation exchange resin and to maintain the solution at a pH close to neutrality after the treatment with the exchangers.

The amounts of adsorbent, supported anion exchange resin, hydrophobic adsorbent with anion exchange groups and anion and cation exchange resins, which may be the same or different, are generally between 10 and 350 g and preferably between 50 and 250 g/liter of raw juice. The use of larger amounts does not go beyond the scope of the invention and an excess of adsorbent, of exchange resin, or exchange group adsorbent and/or resins may make it possible to obtain better efficiency.

After purification, the juices obtained are practically colorless and contain only traces of organic nitrogen impurities, aconitic acid, organic salts, and inorganic salts such as potassium, magnesium and calcium. They consist of a sugar solution, which can be concentrated to form a sugar syrup, which, in turn, can be used as is or be fed to a sucrose crystallization apparatus. In accordance with the process of the invention, the residue of the crystallization operation is not molasses but a solution of sugars such as glucose and levulose, which are difficult to crystallize.

Upon the treatment of the cane juices, the hydrophobic adsorbent retains all of the hydrophobic coloring substances; the supported anion exchange resin retains a large part of the non-hydrophobic coloring substances, a small amount of nitrogen materials comprising in particular all of the proteins, and a small proportion of amino acids; the anion exchange resin retains practically all of the aconitic acid; and the cation exchange resin retains practically all of the amino acids, potassium, magnesium, and calcium.

When a hydrophobic absorbent with anion exchange groups is used, it retains all of the hydrophobic coloring substances, a large part of the non-hydrophobic coloring substances, a small amount of nitrogen materials comprising the proteins, and a small proportion of amino acids. The separation of the impurities retained by the adsorbent and the exchange resins is effected by elution. The elutions eliminate all the products fixed on the adsorbent and the exchangers and permit their reuse numerous times without aging.

Elution comprises treating the hydrophobic adsorbent with an aqueous solution of a $C_1$–$C_6$ alcohol (in particular, ethanol) and/or a ketone such as acetone or methyl ethyl ketone and/or a surface-active agent that can be used in food. That agent may be selected from among the alkaline salts of fatty acids and of alkyl sulfosuccinic acids, such as sodium stearate, sodium oleate, and sodium dioctylsulfosuccinate.

The supported anion exchange resin and the cation exchange resin are eluted by means of an aqueous solution of acidic pH, such as a solution of an inorganic or organic acid, for example, hydrochloric, acetic, nitric, sulfuric, or lactic acids, possibly in the presence of an alcohol or a ketone. The hydrophobic adsorbent bearing anion exchange groups is eluted with an aqueous solution of an alcohol and/or a ketone and/or a surface active agent, as indicated for the hydrophobic adsorbent, but the pH of which is acidified by an acid, as indicated for the supported anion exchanger.

The anion exchange resin is eluted either with an aqueous solution of acid pH, such as described above, or by an aqueous solution of basic pH, such as a solution of alkaline hydroxides (e.g., ammonium, sodium, or potassium hydroxide), possibly in the presence of an inorganic salt such as sodium chloride, potassium chloride, sodium carbonate, or ammonium carbonate.

In accordance with another variant, the process of the invention can be applied to solutions of the low-grade sugar, that is, sugarcane juices that have been clarified, evaporated, crystallized, and redissolved into solution. In this case, the low-grade sugar solutions are contacted with a hydrophobic adsorbent, a supported strong anion exchange material or a hydrophobic adsorbent bearing anion exchange groups, and, optionally, in any order, an anion exchange resin and a cation exchange resin.

This application of the process to low-grade sugar solutions is simple, avoids the use of large amounts of bone char (which are used in the prior art), and makes it possible to effect treatment of the sugar solutions at any time during the year.

The treatment is carried out in the manner previously described for the raw juices; however, the low-grade sugar solutions may be as high as 66° Brix in concentration. Because these solutions contain less impurities than the raw juices, the amounts of hydrophobic adsorbent, anion exchangers, and hydrophobic adsorbent with anion exchange groups can be less than those used for the raw juices, and the minimum amount may be as low as 5 g/liter of solution of low-grade sugar.

This treatment makes it possible to obtain a crystallizable solution when the solution is contacted only with the hydrophobic adsorbent and the supported anion exchange resin or the hydrophobic adsorbent with anion exchange groups. It makes it possible to obtain a sucrose syrup if the crystallizable solution is then contacted with an anion exchange resin and a cation exchange resin. The impurities retained during this treatment are of the same nature as those retained during the treatment of the sugarcane juices and their elution is effected in identical manner.

The mixed products contained in the elution solutions, after treatment of the raw juices or low-grade sugar solutions, can be separated from each other in the form of enriched fractions or pure products by treatment of said solutions by any known separation techniques. Thus, the aconitic acid and the amino acids can be obtained.

Treatment of the sugarcane juices or of the low-grade sugar solutions by the adsorbent and the exchangers can be effected batchwise, semi-continuously in columns, or continuously with series of columns. All three methods give identical results. Continuous treatment is particularly suitable for industrial applications.

Several embodiments of the invention are given below by way of illustration and not of limitation. In these examples, the percentages are by weight, the color of the juice at a pH of 8–10 was determined by measurement of the optical density at 420 nm, and the amount of total nitrogen was determined by the Kjeldahl method. The amount of amino acids was determined by the ninhydrin method and measurement of the optical density at 570 nm. The amount of aconitic acid was determined by colorimetry using the method of Fournier and Vidaurreta (Anal. Chem. Acta 53-1971, pages 387–392) and the amounts of potassium, magnesium, and calcium were measured by flame spectrophotometry.

EXAMPLE 1

There are used:

(A) A hydrophobic adsorbent formed of a silica having a particle size of 100–300 μm, a specific surface of 300 $m^2/g$, an average pore diameter of 90 Å and a pore volume of 1.02 ml/g, coated with 0.20 $mg/m^2$ of a vinyl toluene-vinyltriethoxysilane copolymer and having a carbon content of 5.7%;

(B) A supported anion exchange resin formed of a silica having a particle size of 100–200 μm, a specific surface of 24 $m^2/g$, an average pore diameter of 1000 Å and a pore volume of 0.82 ml/g coated with 6.5 $mg/m^2$ of a styrene-divinylbenzene copolymer bearing—$N^{(+)}$—$(CH_3)_3Cl^{(-)}$ exchanger groups and having the following characteristics:

carbon content 9.8%
chlorine content 1.6%
nitrogen content 0.74%
ion capacity 0.45 meq/g.

(C) An anion exchange resin formed of a styrenedivinylbenzene copolymer having a particle size of 350 to 550 μm, bearing N—$(CH_3)_2$ exchange groups and having the following characteristics:

carbon content 87.3%
nitrogen content 4.3%
ion capacity 2 meq/ml.

(D) A cation exchange resin formed of a styrenedivinylbenzene polymer having a particle size of 450 to 550 μm bearing—$SO_3H$ exchanger groups and having the following properties:

carbon content 76%
sulfur content 6.4%
ion capacity 1.9 meq/ml.

(E) A clear green sugarcane juice prepared by crushing pieces of cane to a fine puree which was then expressed to obtain an opalescent green juice of 18° Brix and then, after addition of 1.10 g of lime in the form of a slurry of 1.5 g/liter per liter of juice, decantation and filtration.

100 g of adsorbent A are introduced into a column (1) of 5 cm diameter and 12 cm in height;

20 g of exchange resin B are introduced into a column (2) of 2.5 cm in diameter and 9 cm in height, and then washed with 1/10 N hydrochloric acid;

100 g of resin C are introduced into a column (3) of 2.5 cm in diameter and 26 cm in height;

100 g of resin D are introduced into a column (4) of 2.5 cm in diameter and 20 cm in height;

500 ml of juice E are percolated in succession through columns 1, 2, 3 and 4 with rates of flow of 200 ml/hr, 35 ml/hr, 170 ml/hr and 170 ml/hr respectively at ambient temperature. Each column is then washed with 100 ml of water.

The characteristics of the juice (color, pH, amounts of total nitrogen, amino acids, aconitic acid, potassium, magnesium, and calcium) are determined before treatment and at the outlet of each column. The results are set forth in Table 1.

TABLE 1

| | Raw juice | Juice after column (1) | Juice after column (2) | Juice after column (3) | Juice after column (4) |
|---|---|---|---|---|---|
| color DO | 1.35 | 0.56 | 0.29 | 0.13 | 0.03 |
| pH | 6.6 | 6.2 | 5.7 | 10.1 | 1.8 |
| total nitrogen g | 1.53 | 1.45 | 1.24 | 1.14 | 0.04 |
| amino acids g | 7.50 | 7.40 | 7.30 | 7.30 | traces |
| aconitic acid g | 2.25 | 2.25 | 2.12 | non-detectable | non-detectable |

TABLE 1-continued

| | Raw juice | Juice after column (1) | Juice after column (2) | Juice after column (3) | Juice after column (4) |
|---|---|---|---|---|---|
| potassium g | 3.37 | 2.97 | 2.89 | 2.75 | traces |
| magnesium g | 0.10 | 0.093 | 0.09 | 0.086 | traces |
| calcium g | 0.30 | 0.28 | 0.28 | 0.18 | traces |

The juice emerging from column (4) is brought to a pH of 7 and then concentrated by heating under vacuum until it has a sucrose content of 65% and can without further purification be used as syrup or be crystallized.

The impurities withheld by the adsorbent of column (1) are eluted by passage of 150 ml of a 2% aqueous solution of sodium dioctylsulfosuccinate. They consist of the hydrophobic coloring substances.

The impurities retained by the exchanger of column (2), which consist of coloring substances and a part of the nitrogen materials (proteins) are eluted by the passage of 120 ml of 1/10 N hydrochloric acid.

The impurities retained by column (3), which consist of 94% of the aconitic acid, are eluted by the passage of 400 ml of 2N hydrochloric acid.

The impurities retained by the resin of column (4), formed of 97% of the amino acids, potassium, magnesium and calcium are eluted by passage of 400 ml of 2N hydrochloric acid.

After rinsing with 100 ml of water, each of the columns can be used again.

EXAMPLE 2

The same procedure is used as in Example 1, with a column (1) identical to that of Example 1, a column (2) identical to that of Example 1, a column (3) of 2.5 cm in diameter and 20 cm in height containing 100 g of exchanger D, and a column (4) of 2.5 cm in diameter and 26 cm in height, containing 100 g of exchanger C. The results are set forth in Table 2.

TABLE 2

| | Raw juice | Juice after column (1) | Juice after column (2) | Juice after column (3) | Juice after column (4) |
|---|---|---|---|---|---|
| color DO | 1.40 | 0.62 | 0.27 | 0.07 | 0.02 |
| pH | 7.2 | 6.8 | 5.9 | 1.6 | 8.2 |
| total nitrogen g | 1.62 | 1.53 | 1.26 | 0.05 | 0.03 |
| amino acids g | 7.70 | 7.60 | 7.40 | 0.20 | traces |
| aconitic acid g | 2.32 | 2.30 | 2.28 | 2.12 | non-dectectable |
| potassium g | 3.42 | 3.35 | 3.17 | traces | traces |
| magnesium g | 0.105 | 0.098 | 0.095 | traces | traces |
| calcium g | 0.313 | 0.297 | 0.295 | traces | traces |

The quality of the juice emerging from column (4) makes it possible to obtain a crystallizable sugar syrup without further purification. The impurities retained by the adsorbent and the exchange resin are eluted as in Example 1. The elution solution of column (1) contains the hydrophobic coloring substances. The elution solution of column (2) contains the majority of the coloring substances not retained by column (1) and the majority of the proteins. The elution solution from column (3) contains 93% of the amino acids and 6% of the aconitic acid. The elution solution of column (4) contains 91% of the aconitic acid.

EXAMPLE 3

There are used:

(A) A hydrophobic adsorbent formed of a silica having a particle size from 100 to 200 μm, a specific surface of 250 $m^2/g$, an average pore diameter of 110 Å and a pore volume of 0.97 ml/g, coated with 0.23 $mg/m^2$ of a styrene-divinylbenzene copolymer and having a carbon content of 6.2%;

(B) A supported anion exchange resin formed of a silica having a particle size of 100–300 μm, a specific surface of 22 $m^2/g$, an average pore diameter of 1200 Å and a pore volume of 0.90 ml/g, coated with 6.1 $mg/m^2$ of a vinyl toluene/vinyl triethoxysilane copolymer having $—N^{(+)}—(CH_3)_3Cl^{(-)}$ exchange groups and the following properties:
carbon content 11.8%
chlorine content 1.5%
nitrogen content 0.69%
ion capacity 0.45 meq/g.

(C) An anion exchange resin formed of a styrene/divinylbenzene copolymer having a particle size of 400–600 μm bearing $—N^{(+)}—(CH_3)_3Cl^{(-)}$ exchange groups and having the following properties:
carbon content 86.2%
chlorine content 3.8%
nitrogen content 1.75%
ion capacity 1.1 meq/ml.

(D) A cation exchange resin formed of a styrene/divinylbenzene copolymer having a particle size of 400 to 600 μm, bearing $—SO_3H$ exchanger groups and having the following properties:
carbon content 75%
sulfur content 7.1%
ion capacity 2.1 meg/ml.

(E) A cane juice prepared in the manner indicated in Example 1.

100 g of adsorbent A are introduced into a column (1) of 5 cm diameter and 12 cm in height;

20 g of exchange resin B are introduced into a column (2) of 2.5 cm in diameter and 9 cm in height, and then washed with 1/10N hydrochloric acid;

100 g of resin C are introduced into a column (3) of 2.5 cm in diameter and 26 cm in height;

100 g of resin D are introduced into a column (4) of 2.5 cm in diameter and 20 cm in height;

350 ml of juice E are percolated in succession through columns (1), (2), (3) and (4) with rates of flow of 200 ml/hr, 35 ml/hr, 170 ml/hr and 170 ml/hr respectively at ambient temperature. Each column was then washed with 100 ml of water.

The characteristics of the juice (color, pH, amounts of total nitrogen, amino acids, aconitic acid, potassium, magnesium, and calcium) are determined before treatment and upon emergence from each column. The results are set forth in Table 3.

TABLE 3

| | Raw juice | Juice after column (1) | Juice after column (2) | Juice after column (3) | Juice after column (4) |
|---|---|---|---|---|---|
| color DO | 1.37 | 0.81 | 0.40 | 0.18 | 0.11 |
| pH | 6.9 | 6.3 | 5.8 | 11.0 | 1.7 |
| total nitrogen g | 1.45 | 1.38 | 1.22 | 1.16 | 0.06 |
| amino acids g | 7.40 | 7.40 | 7.30 | 7.30 | traces |
| aconitic acid g | 2.10 | 2.08 | 1.96 | non-detectable | non-detectable |

TABLE 3-continued

| | Raw juice | Juice after column (1) | Juice after column (2) | Juice after column (3) | Juice after column (4) |
|---|---|---|---|---|---|
| potassium g | 3.25 | 3.05 | 2.95 | 2.80 | traces |
| magnesium g | 0.10 | 0.095 | 0.09 | 0.09 | traces |
| calcium g | 0.30 | 0.29 | 0.29 | 0.21 | traces |

The juice emerging from column (4) is brought to a pH of 7 and then concentrated by heating under vacuum until it has a sucrose concentration of 65% and can, without further purification, be used as syrup or be sent to crystallization apparatus.

The impurities retained by the adsorbent and the exchangers are eluted as in Example 1. The elution solution of column (1) contains the hydrophobic coloring substances. The elution solution of column (2) contains a large amount of non-hydrophobic coloring substances and nitrogen materials comprising the majority of the proteins. The elution solution of column (3) contains 95% of the aconitic acid. The elution solution of column (4) contains 98% of the amino acids.

EXAMPLE 4

The same procedure is employed as in Example 1 but with:

(A) A hydrophobic adsorbent formed of a silica having a particle size of 100 to 300 μm, a specific surface of 25 $m^2/g$, an average pore diameter of 1250 Å and a pore volume of 1.02 ml/g, coated with 2.60 $mg/m^2$ of a vinyl toluene/vinyltriethoxysilane copolymer and having a carbon content of 6.6%.

The results are set forth in Table 4

TABLE 4

| | Raw juice | Juice after column (1) | Juice after column (2) | Juice after column (3) | Juice after column (4) |
|---|---|---|---|---|---|
| color DO | 2.10 | 0.55 | 0.14 | 0.04 | 0.025 |
| pH | 7.8 | 7.6 | 7.6 | 10.3 | 1.8 |
| total nitrogen g | 1.17 | 1.02 | 0.95 | 0.81 | 0.04 |
| amino acids g | 7.45 | 7.40 | 7.40 | 7.30 | traces |
| aconitic acid g | 2.02 | 1.96 | 1.79 | traces | traces |
| potassium g | 2.37 | 2.37 | 2.20 | 1.92 | traces |
| magnesium g | 0.11 | 0.11 | 0.10 | 0.09 | traces |
| calcium g | 0.44 | 0.40 | 0.37 | 0.32 | traces |

The juice emerging from column (4) is brought to a pH of 7 and then concentrated by heating under vacuum until it has a sucrose concentration of 65% and can, without further purification, be employed as syrup or be crystallized.

The impurities retained by the adsorbent of column (1) are eluted by passage of 300 ml of a 2% aqueous solution of sodium dioctyl sulfosuccinate. They are formed of the hydrophobic coloring substances.

The impurities retained by the exchangers are eluted as in Example 1. The elution solution of column (2) contains the majority of the non-hydrophobic coloring substances and the majority of the proteins. The elution solution of column (3) contains 88.5% of the aconitic acid. The elution solution of column (4) contains 98% of the amino acids.

After rinsing with 100 ml of water, each of the columns can be used again.

EXAMPLE 5

There are employed:

(A) A hydrophobic adsorbent formed of beads of polystyrene cross-linked by divinylbenzene, having a carbon content of 82.7%. The beads have a particle size of 100–300 μm, a specific surface of 5 $m^2/g$, an average pore diameter of 140 Å and a pore volume of 0.35 ml/g.

(B) A supported anion exchange material formed of a silica having a particle size of 100 to 300 μm, a specific surface of 110 $m^2/g$, an average pore diameter of 280 Å and a pore volume of 0.89 ml/g coated with 6.5 $mg/m^2$ of a styrene/divinylbenzene copolymer bearing $—N^{(+)}—(CH_3)_3Cl^{(-)}$ exchanger groups and having the following properties:

carbon content 16.9%
chlorine content 2.6%
nitrogen content 1.2%
ion capacity 0.75 meq/g.

(C) An anion exchange resin formed of a styrene/divinylbenzene copolymer having a particle size of from 300 to 1200 μm bearing $—N—(CH_3)_2$ exchanger groups and having the following properties:

carbon content 68.5%
nitrogen content 8%
ion capacity 1.4 meq/ml.

(D) A cation exchange resin formed of a styrene/divinylbenzene polymer having a particle size of 300 to 800 μm bearing $—SO_3H$ exchanger groups and having the following properties:

carbon content 76%
sulfur content 6.4%
ion capacity 1.9 meq/ml.

(E) A clear green sugar juice prepared by crushing pieces of cane to a fine puree which is then pressed to obtain an opalescent green juice of 22° Brix followed then after addition of 1.10 g of lime in the form of a slurry of 1.5 g/liter per liter of juice by settling and filtration.

100 g of adsorbent A are introduced into a column (1) of 5 cm in diameter and 30 cm in height;

20 g of exchange material B are introduced into a column (2) of 2.5 cm in diameter and 9 cm in height and then washed with 1/10N hydrochloric acid.

100 g of resin C are introduced into a column (3) of 2.5 cm in diameter and 27 cm in height;

100 g of resin D are introduced into a column (4) of 2.5 cm in diameter and 20 cm in height;

300 ml of juice E are percolated in succession through columns (1), (2), (3) and (4) with rates of flow of 350 ml/hr, 150 ml/hr, 300 ml/hr and 300 ml/hr respectively at ambient temperature. Each column is then washed with 100 ml of water.

The results are set forth in Table 5.

TABLE 5

| | Raw juice | Juice after column (1) | Juice after column (2) | Juice after column (3) | Juice after column (4) |
|---|---|---|---|---|---|
| color DO | 5.90 | 0.725 | 0.05 | 0.021 | .0.012 |
| pH | 6.2 | 6.2 | 4.5 | 11 | 3.7 |
| total nitrogen mg | 41.4 | 40.2 | 33.6 | 19.2 | 14.4 |
| amino acids | 7.60 | 7.50 | 7.45 | 7.45 | traces |
| aconitic acid g | 1 | 0.98 | 0.94 | 0.04 | traces |
| potassium mg | 400 | 280 | 260 | 160 | traces |
| magnesium mg | 27 | 22 | 20 | 4.8 | traces |

TABLE 5-continued

| | Raw juice | Juice after column (1) | Juice after column (2) | Juice after column (3) | Juice after column (4) |
|---|---|---|---|---|---|
| calcium mg | 66 | 51 | 51 | 36 | traces |

The juice emerging from column (4) is brought to a pH of 7 and then concentrated by heating under vacuum until it has a sucrose concentration of 65% and can, without further purification, be employed as syrup or be crystallized.

The impurities retained by the adsorbent of column (1) are eluted by passage of 250 ml of a 50% aqueous solution of ethanol. They consist of the hydrophobic coloring substances.

The impurities retained by the exchanger of column (2), formed of coloring materials and a part of the nitrogen materials (proteins) are eluted by passage of 100 ml of 1/10N hydrochloric acid.

The impurities retained by the resin of column (3), containing 90% of the aconitic acid, are eluted by passage of 300 ml of an aqueous solution of 20 g/liter of caustic soda and 100 g/liter of sodium chloride, in the form of sodium aconitate.

The impurities retained by the resin of column (4), consisting of 98% of the amino acids, of potassium, magnesium and calcium are eluted by passage of 400 ml of 2N hydrochloric acid.

After rinsing with 100 ml of water each of the columns can be used again.

EXAMPLE 6

There are used:

(A) A hydrophobic adsorbent having anion exchange groups formed of a silica having a particle size of 100 to 300 μm, a specific surface of 62 $m^2/g$, an average pore diameter of 600 Å and a pore volume of 0.90 ml/g, coated with 2.7 $mg/m^2$ of a styrene-vinyltriethoxysilane copolymer bearing $—N^{(+)}—(CH_3)_3Cl^{(-)}$ exchanger groups and having the following properties:

carbon content 16.3%
chlorine content 0.2%
nitrogen content 0.5%
ion capacity 0.1 meq/g.

(B) An anion exchange resin formed of a styrene/divinylbenzene copolymer having a particle size of 400 to 1000 μm bearing $—N—(CH_3)_2$ exchanger groups and having the following properties:

carbon content 78.3%
nitrogen content 3.4%
ion capacity 1.1 meq/ml.

(C) A cation exchange resin identical to the cation exchanger resin (D) of example 1;

(D) A cane juice of 20° Brix prepared as in Example 1.

50 g of the adsorbent A are introduced into a column (1) of a diameter of 2.5 cm and a height of 20 cm.

50 g of resin B are introduced into a column (2) of a diameter of 2.5 cm and a height of 13 cm;

50 g of resin C are introduced into a column (3) of a diameter of 2.5 cm and a height of 10 cm;

500 ml of juice D are percolated in succession through columns (1), (2) and (3) with rates of flow of 120 ml/hr, 100 ml/hr and 110 ml/hr respectively at ambient temperature. Each column is then washed with 80 ml of water.

The results are set forth in Table 6.

TABLE 6

| | Raw juice | Juice after column (1) | Juice after column (2) | Juice after column (3) |
|---|---|---|---|---|
| color DO | 3.6 | 0.048 | 0.018 | 0.012 |
| pH | 6.9 | 6 | 10.8 | 8.5 |
| total nirogen mg | 95 | 89 | 85 | 3 |
| amino acids g | 7.55 | 7.55 | 7.50 | traces |
| aconitic acid g | 1.26 | 1.13 | 0.10 | 0.09 |
| potassium g | 1.02 | 0.98 | 0.70 | traces |
| magnesium mg | 87 | 71 | 15.4 | traces |
| calcium mg | 110 | 85 | 62 | traces |

The juice emerging from column (3) is brought to a pH of 7 and then concentrated by heating under vacuum until it has a sucrose concentration of 65% and can, without further purification, be used as syrup or be crystallized.

The impurities retained by the exchanger of column (1) are eluted by passage of 220 ml of a solution formed of equal parts of 1/10N hydrochloric acid and ethanol. They consist of the hydrophobic coloring substances, the coloring materials and a part of the nitrogen materials.

The impurities retained by the resin of column (2), containing 81.5% of the aconitic acid, are eluted by passage of 250 ml of 2N hydrochloric acid.

The impurities retained by the resin of column (3), formed of 99% of the amino acids, potassium, magnesium and calcium are eluted by passage of 250 ml of 2N hydrochloric acid.

After rinsing with 100 ml of water, each of the columns can be used again.

EXAMPLE 7

There are used:

(A) A hydrophobic adsorbent having anion exchanger groups formed of a silica having a particle size of 100 to 200 μm, a specific surface of 24 $m^2/g$, an average pore diameter of 1000 Å and a pore volume of 0.82 ml/g, coated with 2.2 $mg/m^2$ of a styrene/divinylbenzene copolymer bearing $—N^{(+)}—(CH_3)_3Cl^{(-)}$ exchanger groups and having the following properties:

carbon content 4.3%
chlorine content 0.7%
nitrogen content 0.31%
ion capacity 0.2 meq/g.

(B) An anion exchange resin formed of a styrene/divinylbenzene copolymer having a particle size of 350 to 550 μm, bearing $—N—(CH_3)_2$ exchanger groups and having the following properties:

carbon content 87.3%
nitrogen content 4.3%
ion capcacity 2 meq/ml.

(C) A cation exchange resin identical to the cation exchange resin (D) of Example 1;

(D) A low-grade sugar solution obtained by dissolving crystalline sugar in water in such amounts that the concentration of the solution is 20° Brix.

4 g of adsorbent A are introduced into a column (1) of 1 cm in diameter and 10 cm in height;

40 g of resin B are introduced into a column (2) of 2.5 cm in diameter and 10 cm in height;

50 g of resin C are introduced into a column (3) of 2.5 cm in diameter and 10 cm in height;

500 ml of juice D are percolated in succession through columns (1), (2) and (3) with rates of flow of 120 ml/hr, 100 ml/hr and 100 ml/hr respectively at ambient temperature. Each column is then washed by 60 ml of water.

The results are set forth in Table 7.

TABLE 7

| | Low-grade sugar solution | Solution after column (1) | Solution after column (2) | Solution after column (3) |
|---|---|---|---|---|
| color DO | 0.295 | 0.063 | 0.022 | 0.019 |
| pH | 6.9 | 6.5 | 10.9 | 8.4 |
| total nitrogen mg | 22 | 18 | 16 | 15 |
| amino acids mg | 21 | 18 | 17 | 15 |
| aconitic acid ppm | 143 | 131 | 36 | 36 |
| potassium mg | 10 | 9.5 | 9 | 0 |
| magnesium mg | 2 | 2 | 2 | traces |
| calcium mg | 6.5 | 6 | 5 | traces |

The solution emerging from column (3) which is concentrated by heating under vacuum up to a sucrose concentration of 65% can be used as sucrose syrup.

The impurities retained by the exchanger of column (1) are eluted by passage of 50 ml of a solution formed of equal parts of 1/10N hydrochloric acid and ethanol.

The impurities retained by the resin of column (2) are eluted by passage of 200 ml of 2N sodium hydroxide solution.

The impurities retained by the resin of column (3) are eluted by passage of 200 ml of 2N hydrochloric acid.

After rinsing with 100 ml of water, each of the columns can be used again.

Variations and modifications will be obvious to one skilled in the art and the claims are intended to cover all variations and modifications that fall within the true spirit and scope of the invention.

I claim:

1. A process of purifying sugarcane juices, comprising the steps of first contacting the sugarcane juices to be purified with a hydrophobic adsorbent and next with a supported strong anion exchange material, then contacting the juices, in any order, with an anion exchange resin and a cation exchange resin, and finally eluting aconitic acid retained by the anion exchange resin of the then contacting step with a solution of acid pH or a solution of basic pH, thereby obtaining aconitic acid or aconitate, wherein the juices to be purified are obtained by crushing and pressing cane, adding a flocculating agent to the juices obtained, and centrifuging and filtrating the resulting mixture so that it has a concentration of sugars of 10° to 25° Brix, and wherein the hydrophobic adsorbent is selected from the group consisting of a cross-linked vinyl aromatic polymer and a mineral support of alumina or silica coated with an amount of less than 15 mg/m$^2$ of a film of cross-linked vinyl aromatic polymer, said adsorbent having a particle size of 50 to 5000 μm, a specific surface of 5 to 600 m$^2$/g, a pore diameter of 60 to 3000 Å, and a pore volume of 0.2 to 4 ml/g.

2. A process according to claim 1, wherein the supported strong anion exchange material is formed of a mineral support of alumina or silica coated with an amount of less than 15 mg/m$^2$ of a cross-linked polymer film obtained from epoxy compounds, formaldehyde, and vinyl monomers, said polymer containing or bearing quaternary ammonium salt exchange groups, said exchange material having a particle size of 4 to 5000 μm, a specific surface of 5 to 150 m$^2$/g, a pore diameter of 60 to 3000 Å, a pore volume of 0.2 to 4 ml/g, and an ion capacity of less than 2 meq/g.

3. A process according to any of claims 1 or 2, wherein the anion exchange resin is formed of a cross-linked vinyl polymer containing or bearing primary, secondary, or tertiary amine exchange groups or quaternary ammonium salts and has a particle size of 100 to 5000 μm and an ion capacity of 0.5 to 4 meq/ml.

4. A process according to any of claims 1 or 2, wherein the cation exchange resin is formed of a cross-linked vinyl polymer containing or bearing carboxylic or sulfonic acid exchange groups and has a particle size of 100 to 5000 μm and an ion capacity of 0.5 to 4 meq/ml.

5. A process according to any of claims 1 or 2, wherein the process is carried out with juices having a pH of between 5 and 12 and at temperatures of between 15° and 80° C.

6. A process according to any of claims 1 or 2, wherein the amounts used of hydrophobic adsorbent, supported anion exchange material, anion exchange resin and cation exchange resin are between 10 and 350 g liter of cane juice.

7. The process of claim 1 further comprising as the last step the step of concentrating the sugarcane juice, thereby obtaining sugar syrup.

8. The process of claim 7 further comprising as the last step the step of crystallizing the syrup, thereby obtaining sucrose.

9. A process for the purification of low-grade sugar solutions comprising the steps of first contacting the low-grade sugar solutions with a hydrophobic adsorbent, next contacting the low-grade sugar solutions with a supported strong anion exchange material, then contacting the low-grade sugar solutions, in any order, with an anion exchange resin and a cation exchange resin, and finally eluting aconitic acid retained by the anion exchange resin of the then contacting step with a solution of acid pH or a solution of basic pH, thereby obtaining aconitic acid or aconitate, wherein the low-grade sugar solution is obtained from sugarcane juice by clarification,, evaporation, crystallization and redissolution, said sugarcane juices being obtained by crushing and pressing cane, adding a flocculating agent to the juices obtained, and centrifuging and filtrating the resulting mixture so that it has a concentration of sugars of 10° to 25° Brix, and wherein the hydrophobic adsorbent is selected from the group consisting of a cross-linked vinyl aromatic polymer and a mineral support of alumina or silica coated with an amount of less than 15 mg/m$^2$ of a film of cross-linked vinyl aromatic polymer, said adsorbent having a particle size of 50 to 5000 μm, a specific surface of 5 to 600 m$^2$/g, a pore diameter of 60 to 3000 Å, and a pore volume of 0.2 to 4 ml/g.

10. A process according to claim 9, wherein the minimum amounts used of hydrophobic adsorbent and supported anion exchange material are 5 g/liter of low-grade sugar solution.

11. The process of claim 9 or 10 further comprising as the last two steps the steps of concentrating and then crystallizing the low-grade sugar solution purified, thereby obtaining sucrose.

12. The process of claim 9 or 10 further comprising as the last step of concentrating the low-grade sugar solutions purified, thereby obtaining sucrose syrup.

13. The process of any one of claims 1 or 9 further comprising the step of eluting amino acids retained by the cation exchange resin with a solution of acid pH, thereby obtaining fractions enriched in amino acids.

* * * * *

UNITED STATES PATENT AND TRADEMARK OFFICE

CERTIFICATE OF CORRECTION

PATENT NO. : 4,523,959

DATED : June 18, 1985

INVENTOR(S) : Michel Exertier

It is certified that error appears in the above—identified patent and that said Letters Patent is hereby corrected as shown below:

Col. 12, line 8, "nirogen" should be --nitrogen--

Signed and Sealed this

Thirteenth Day of September, 1988

*Attest:*

DONALD J. QUIGG

*Attesting Officer*

*Commissioner of Patents and Trademarks*